US009889484B2

(12) United States Patent
Wafer

(10) Patent No.: US 9,889,484 B2
(45) Date of Patent: Feb. 13, 2018

(54) RUB RAIL REPAIR TOOL AND METHOD

(71) Applicant: Stephen Wafer, Missouri City, TX (US)

(72) Inventor: Stephen Wafer, Missouri City, TX (US)

( * ) Notice: Subject to any disclaimer, the term of this patent is extended or adjusted under 35 U.S.C. 154(b) by 0 days.

(21) Appl. No.: 15/349,537

(22) Filed: Nov. 11, 2016

(65) Prior Publication Data

US 2017/0056948 A1 Mar. 2, 2017

Related U.S. Application Data

(62) Division of application No. 14/706,168, filed on May 7, 2015, now Pat. No. 9,597,720.

(51) Int. Cl.

| | |
|---|---|
| ***B21D 3/00*** | (2006.01) |
| ***B21D 3/16*** | (2006.01) |
| ***B21D 3/14*** | (2006.01) |

(52) U.S. Cl.

CPC ..... *B21D 3/16* (2013.01); *B21D 3/005* (2013.01); *B21D 3/14* (2013.01); *Y10T 29/49748* (2015.01)

(58) Field of Classification Search

CPC ... B21D 1/06; B21D 1/08; B21D 1/10; B21D 1/12; B21D 1/14; B21D 3/00; B21D 3/005; B21D 3/14; B21D 3/16; B21D 7/024; Y10T 29/49618; Y10T 29/49718; Y10T 29/49725; Y10T 29/49748; Y10T 29/53896; Y10T 29/53943; Y10T 29/53796; B29C 53/16; B29C 53/18; B29C 53/20; F16L 55/88

USPC ..... 72/457, 458, 459, 479, 705; 254/120, 254/123, 124, 126, 129, 131, 131.5; 29/402.01, 402.05, 402.19

See application file for complete search history.

(56) References Cited

U.S. PATENT DOCUMENTS

| | | | | | |
|---|---|---|---|---|---|
| 3,531,972 | A * | 10/1970 | Smith | B21D 3/10 | 72/390.5 |
| 3,568,732 | A * | 3/1971 | Kelly, Jr. | H02G 1/02 | 140/123 |
| 4,483,175 | A * | 11/1984 | Hansen | B21D 3/10 | 72/390.5 |
| 5,327,769 | A * | 7/1994 | Price | B21D 3/10 | 72/211 |
| 2013/0205853 | A1* | 8/2013 | Adomavicius | B21D 1/06 | 72/31.01 |

* cited by examiner

*Primary Examiner* — Peter DungBa Vo
*Assistant Examiner* — Joshua D Anderson
(74) *Attorney, Agent, or Firm* — Richard A. Fagin

(57) ABSTRACT

A rub rail repair tool includes a tool engaging element disposed on one longitudinal side of a flange. A working element is disposed on the other longitudinal side of the flange. The working element is shaped to define a maximum diameter dimension and a minimum diameter dimension. The maximum diameter dimension is substantially equal to a distance between an undamaged rub rail affixed to a lateral edge of a truck bed frame. At least one tool engaging feature is formed in the tool engaging element. The tool engaging feature enables coupling of a torque arm to the tool engaging element to enable rotation thereof about a longitudinal axis thereof by applying force to the torque arm.

6 Claims, 2 Drawing Sheets

RUB RAIL REPAIR TOOL AND METHOD

CROSS-REFERENCE TO RELATED APPLICATIONS

This is a divisional of U.S. patent application Ser. No. 14/706,168 filed on May 7, 2015 and incorporated herein by reference in its entirety.

STATEMENT REGARDING FEDERALLY SPONSORED RESEARCH OR DEVELOPMENT

Not applicable.

THE NAMES OF PARTIES TO A JOINT RESEARCH AGREEMENT

Not Applicable

BACKGROUND

This disclosure relates generally to the field of transport truck and trailer load carrying bed frames. More specifically, the disclosure relates to methods and tools for repairing protective rails ("rub rails") on load carrying bed frames.

Load carrying beds on certain types of trucks and trailers are flat, wherein a load is retained on the bed surface by tensioned straps. The straps include features to hold the ends thereof to an edge of the bed frame, for example, hooks. The straps may be made from woven high strength fiber, such as nylon, aramid or other fiber. Bed frames may include protective rails spaced at a selected distance from the lateral edges of the bed frame. Such rails are known as rub rails. Rub rails are used to protect straps from damage caused by abrasion or cutting. The rub rail is disposed externally to the positions along the bed frame where the straps attach. In the event an object contacts the bed frame, having a rub rail present may prevent the object from contacting the strap, thus possibly avoiding damage.

Rub rails are subject to damage by contact with objects, either or both from collision when the truck is operated on a roadway or in loading or unloading devices from the truck bed. Damage may take the form of bending such that a distance between the lateral edge of the bed frame and the rub rail is reduced such that straps cannot be affixed to the bed frame or removed from the bed frame.

It is known in the art to repair damaged rub rails by cutting the damaged section and replacing it with new material, such as by welding. Such repairs are time consuming and may be costly.

DETAILED DESCRIPTION

Figure 1:
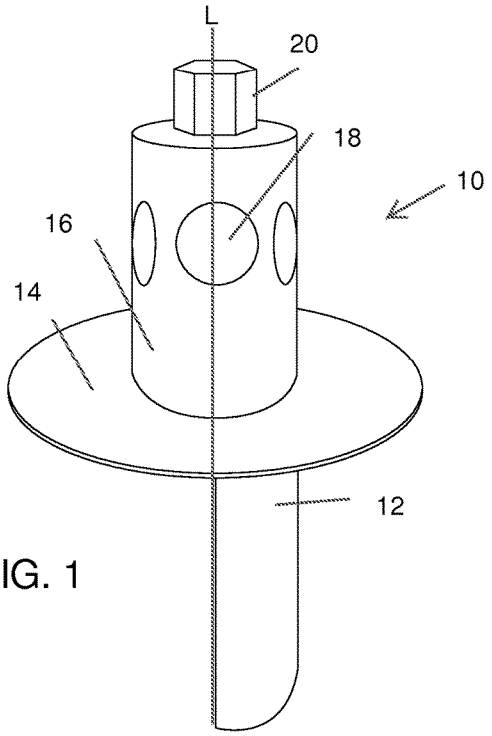
FIGS. 1 through 4 show example embodiments of a rub rail repair tool.

Various example embodiments of a rib rail repair tool 10 are shown in FIGS. 1 through 4. Features that may be common to all the example embodiments include a tool working element 12 disposed on one side of a flange 14. The flange 14 may be substantially planar, circularly shaped and oriented in a direction transverse to a longitudinal axis L (FIG. 1) of the tool 10. A torque arm engaging element 16 may be disposed on the other side of the flange 14. The working element 12, the flange 14 and the torque arm engaging element 16 may be formed from a single piece of metal, for example, steel, or may be welded together or otherwise assembled from separate components.

The torque arm engaging element 16 may be cylindrically shaped and have one or more tool engagement features thereon. In FIG. 1, example tool engagement features on the torque arm engaging element 16 may include, for example a socket head 20 that may be engaged with a suitably sized wrench socket. The example embodiment shown in FIG. 1 is hexagonal; other embodiments of a socket head may be twelve point, or may be a specialized shape such as a TORX brand drive head. TORX is a registered trademark of Acument Intellectual Properties, LLC, 840 West Long Lake Road, Troy Mich. 48098. Other possible socket head shapes will occur to those skilled in the art.

The example embodiment shown in FIG. 1 may also include pass through openings 18 in the torque arm engaging element 16. Pass through openings may be used wherein a torque arm is a rod, pipe or other tool having a selected length. Use of the torque arm will be explained with reference to FIG. 5.

Figure 2:
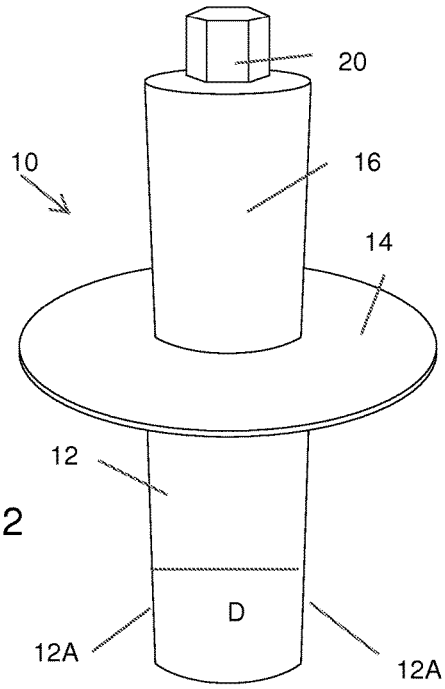

In FIG. 2, the torque arm engaging element 16 may include only the socket head 20. FIG. 2 illustrates an aspect of the working element 12. The working element 12 may define a minimum thickness or diameter dimension (FIG. 4) and a maximum thickness or diameter dimension D. In the present example embodiment, the maximum thickness or diameter dimension D may be substantially equal to a spacing (FIG. 5) between an undamaged rub rail and a lateral edge of a truck bed frame. Lateral ends 12A of the working element 12 as may be configured in some embodiments will be further explained with reference to FIG. 3.

Figure 3:
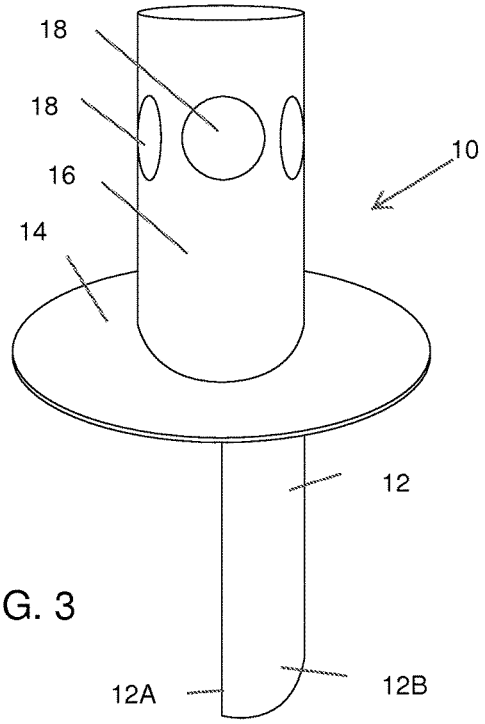

FIG. 3 shows another example embodiment of the torque arm engaging element 16. In the embodiment of FIG. 3, only through openings 18 are included. FIG. 3 also shows another aspect of the working element 12. In the present example embodiment, the working element may include a rounded surface 12B extending across the maximum diameter dimension (D in FIG. 2). The lateral ends 12A of the rounded surface 12B may be formed as small radius corners, for example having a maximum radius of 0.05 inches. Shaping the lateral ends 12A in such manner, i.e., having a small radius, may provide the working element 12 with enhanced capability to grip the metal of the bed frame and/or the rub rail so that the working element 12 will remain essentially stationary along the longitudinal dimension of the space between the rub rail and the lateral edge of the bed frame (see FIG. 5). In this way, the working element may operate to bend the rub rail more efficiently for repair.

Figure 4:
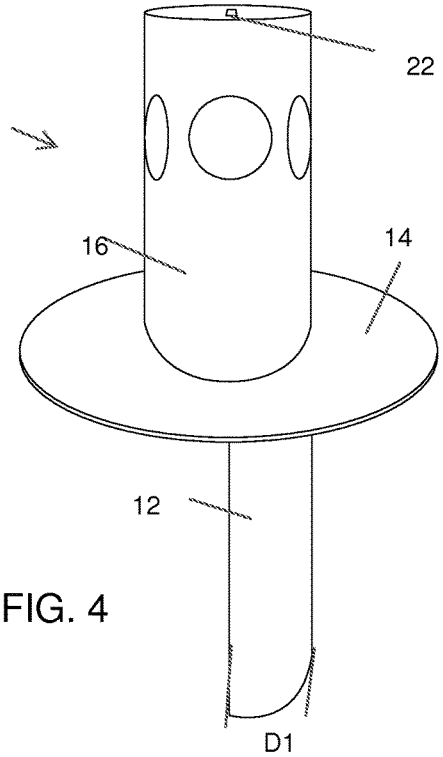

FIG. 4 shows another embodiment of the repair tool 10 in which the torque arm engaging element 16 may include a square drive opening 22 formed in its upper surface. The square drive opening 22 may be used so that a square drive impact wrench, torque bar, ratchet wrench or similar tool may be used to rotate the repair tool 10. FIG. 4 also shows that the working element 12 may define a minimum thickness or diameter dimension D1. In the present example embodiment, the maximum diameter dimension (D in FIG. 2), the lateral edges (12A in FIG. 3) and the minimum diameter dimension D1 may be defined by shaping the working element 12 as a half-cylinder. Other shapes that obtain the same respective dimensions and features will occur to those skilled in the art. The half-cylinder in the present example embodiment may have the advantage of being easy to make from simple bar stock.

Figure 5:
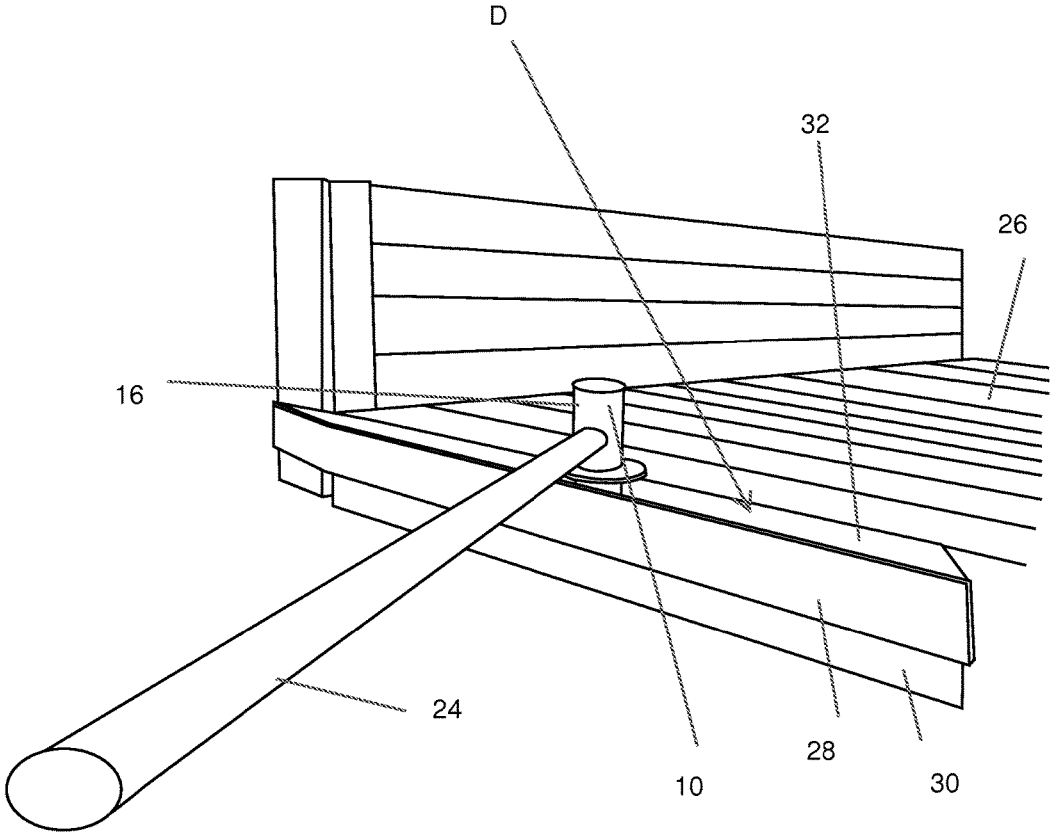
FIG. 5 shows an example method for repairing a rub rail using a tool such as shown in FIGS. 1 through 4.

FIG. 5 shows a method for repairing a rub rail 28 attached to a lateral edge of a truck load bed frame 30 using a repair tool 10 according to the present disclosure. The truck load bed 26 may rest on a frame having lateral edges 30. The rub rail 28 may be affixed to the lateral edges 30 such that a nominal size opening 32 exists between the rub rail 28 and the lateral edge 30 of the bed frame when undamaged. The nominal size opening 32 may be the same as the largest diameter dimension D of the working element (12 in FIG. 4) of the repair tool 10. To use the repair tool 10 to repair an inwardly bent rub rail 28, the repair tool 10 may be inserted into the opening 32 oriented such that the smallest diameter dimension (D1 in FIG. 4) is substantially parallel to the rub rail 28 and the lateral edge 30. A torque arm 24 may be coupled to the torque arm engaging element 16. The repair tool 10 may be inserted until the flange (14 in FIGS. 1 through 4) rests on the rub rail 28 and the lateral edge 30. A torque arm 24 may be coupled to the tool engaging element 16 in any manner such as explained with reference to FIGS. 1 through 4. The repair tool 10 may be rotated by applying force to the torque arm 24 such that the working element (12 in FIGS. 1 through 4) rotates such that its largest diameter dimension (D in FIG. 2) is oriented between the rub rail 28 and the lateral edge 30. Thus, the rub rail 28 may be bent back outward to approximately restore the dimension D between the rub rail 28 and the lateral edge.

A rub rail repair tool and method according to the present disclosure may reduce the time and cost to repair damaged rub rails, while increasing the safety of such repairs by eliminating the need for cutting and welding of damaged rub rail sections.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A rub rail repair tool, comprising:

a tool engaging element disposed on one longitudinal side of a flange;

a working element disposed on the other longitudinal side of the flange, the rub repair tool having a longitudinal axis extending from the tool engaging element to the working element, the working element being shaped to define a maximum diameter dimension and a minimum diameter dimension, each diameter dimension being disposed at opposite sides of the longitudinal axis, the maximum diameter dimension being substantially equal to a distance between an undamaged rub rail affixed to a lateral edge of a truck bed frame; and at least one tool engaging feature in the tool engaging element, the tool engaging feature enabling coupling of a torque arm to the tool engaging element to enable rotation thereof about the longitudinal axis by applying force to the torque arm to enable the maximum diameter dimension of the working element to be oriented between a damaged rub rail and the lateral edge of the truck bed frame to thereby bend the damaged rub rail away from the lateral edge.

2. The rub rail repair tool of claim 1 wherein the working element is shaped substantially as a half-cylinder.

3. The rub rail repair tool of claim 1 wherein at least one edge defined by the maximum diameter dimension has a radius selected to enable gripping of a metal surface of the rub rail or the lateral edge.

4. The rub rail repair tool of claim 3 wherein the radius is at most 0.05 inches.

5. The rub rail repair tool of claim 1 wherein the tool engaging element, the flange and the working element are assembled from separate components.

6. The rub rail repair tool of claim 1 wherein the at least one tool engaging feature comprises one of an opening through the tool engaging element, a socket head and a square drive opening.

* * * * *